US007343108B2

(12) United States Patent
Lairmore et al.

(10) Patent No.: US 7,343,108 B2
(45) Date of Patent: Mar. 11, 2008

(54) APPARATUS AND PROCESS FOR ALTERING TIMING IN AN ELECTROGRAPHIC PRINTER

(75) Inventors: Anne F. Lairmore, Hilton, NY (US); James A. Zimmer, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 274 days.

(21) Appl. No.: 11/121,551

(22) Filed: May 4, 2005

(65) Prior Publication Data

US 2005/0249513 A1 Nov. 10, 2005

Related U.S. Application Data

(60) Provisional application No. 60/568,195, filed on May 5, 2004.

(51) Int. Cl.
*G03G 15/00* (2006.01)

(52) U.S. Cl. ..... 399/38; 399/162

(58) Field of Classification Search ..... 399/38, 399/66, 162, 163

See application file for complete search history.

(56) References Cited

U.S. PATENT DOCUMENTS

| | | | | |
|---|---|---|---|---|
| 4,025,186 | A | 5/1977 | Hunt et al. | |
| 4,416,534 | A * | 11/1983 | Kluger | |
| 4,914,477 | A | 4/1990 | Young et al. | |
| 4,986,526 | A | 1/1991 | Dastin | |
| 5,040,003 | A | 8/1991 | Willis | |
| 5,200,791 | A | 4/1993 | Dastin et al. | |
| 5,455,656 | A * | 10/1995 | Covert et al. | 399/163 |
| 5,504,568 | A * | 4/1996 | Saraswat et al. | |
| 5,506,660 | A * | 4/1996 | Rabb et al. | 399/66 |
| 5,565,975 | A * | 10/1996 | Kumon et al. | |
| 5,878,320 | A * | 3/1999 | Stemmle | 399/163 |
| 5,933,679 | A * | 8/1999 | Palumbo | |
| 5,956,544 | A | 9/1999 | Stern et al. | |
| 6,121,986 | A | 9/2000 | Regelsberger et al. | |
| 6,181,887 | B1 | 1/2001 | Hughes et al. | |
| 6,295,424 | B1 | 9/2001 | Regelsberger et al. | |
| 6,641,134 | B1 | 11/2003 | Dobbertin et al. | |
| 6,842,602 | B2 * | 1/2005 | Kudo | |
| 2001/0017645 | A1 * | 8/2001 | Toda | |
| 2004/0076450 | A1 * | 4/2004 | Martin et al. | 399/162 |

FOREIGN PATENT DOCUMENTS

| | | | |
|---|---|---|---|
| EP | 1111476 | | 8/2002 |
| JP | 10307487 | A * | 11/1998 |
| WO | 01/89194 | | 11/2001 |
| WO | 02/10860 | | 2/2002 |
| WO | 02/14957 | | 2/2002 |

* cited by examiner

*Primary Examiner*—Susan Lee
(74) *Attorney, Agent, or Firm*—Donna P. Suchy

(57) ABSTRACT

The invention is in the field of timing control of electrographic machines. The invention is particularly suited for changing from one frame mode to another. Printing processes and apparatus are provided wherein timing signals are generated, such as one periodic timing signal having a period corresponding to a first frame size, and another alternative periodic timing signal having a period corresponding to a second frame size that is different from the first period The printing process and apparatus creates indicium that are at variable distances and create alternate frame modes to improve productivity with receiver sheets of various sizes. A splice indicium indicating a location of a splice in the electrographic imaging member may also be provided.

20 Claims, 7 Drawing Sheets

APPARATUS AND PROCESS FOR ALTERING TIMING IN AN ELECTROGRAPHIC PRINTER

CROSS REFERENCE TO RELATED APPLICATIONS

This is a 111A application of Provisional Application Ser. No. 60/568,195, filed May 5, 2004, entitled APPARATUS AND PROCESS FOR ALTERING TIMING IN AN ELECTROGRAPHIC PRINTER by Anne F. Lairmore and James A. Zimmer, Jr.

BACKGROUND OF THE INVENTION

The invention is in the field of timing control of electrographic machines.

U.S. Pat. No. 4,025,186 to Hunt, Jr. et al is representative of a number of publications and commercial apparatus in which indicia on an endless web are used to control timing of a reproduction apparatus. In that apparatus an electrophotographic web has a series of perforations (sometimes called "perfs") along one or both edges. The perforations are sensed at a position along the path of the web and the resulting indications of the presence of a perforation are sent to a logic and control means which controls the timing of various portions of the apparatus. The logic and control means may include a clock which creates an underlying set of clock pulses which are used to control the timing of the machine. The clock is regularly updated by the indications from the sensing means.

DETAILED DESCRIPTION OF THE INVENTION

Figure 1:
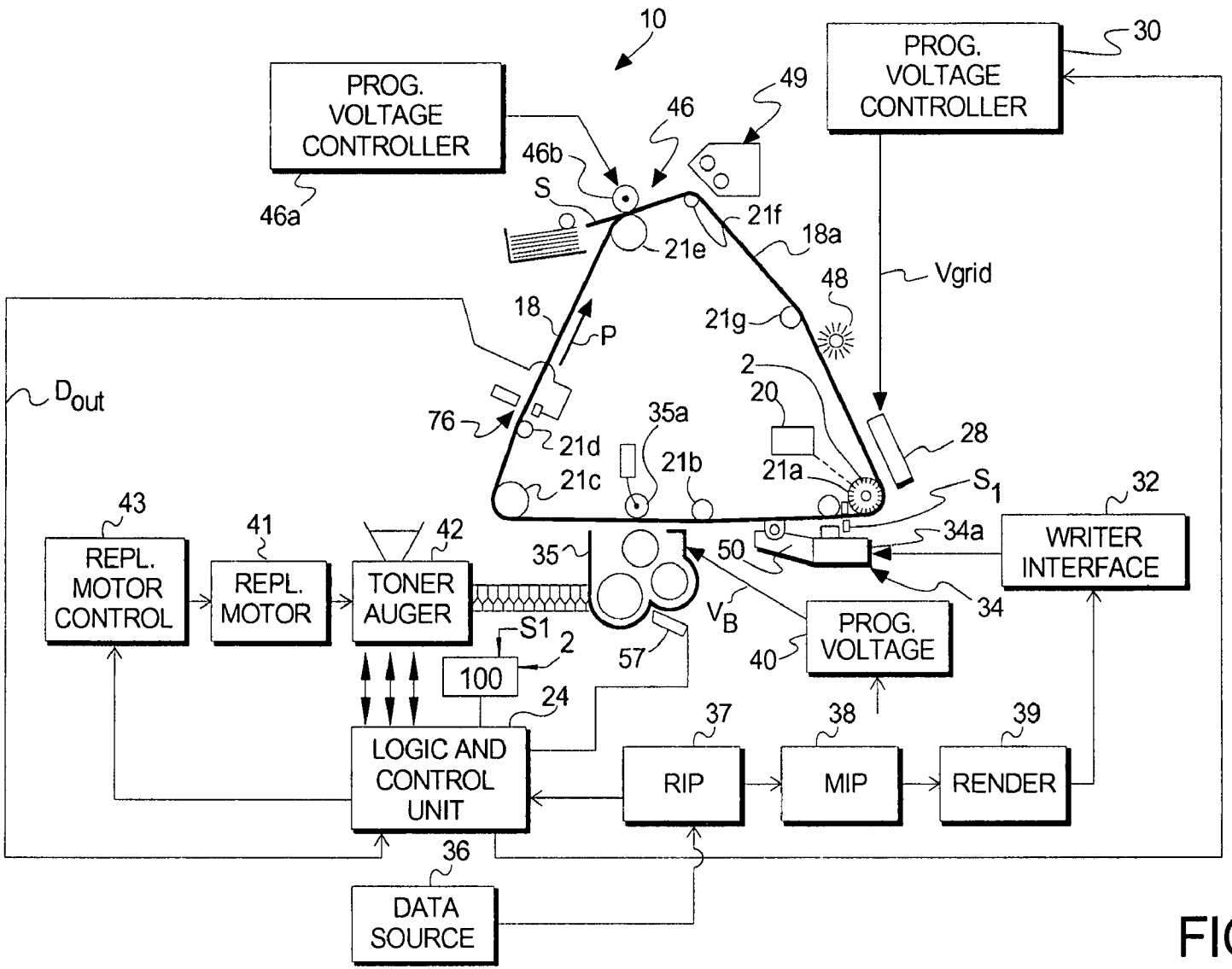
FIGS. 1 and 2 present schematic diagrams of an electrographic marking or reproduction system in accordance with the present invention.
Figure 2:
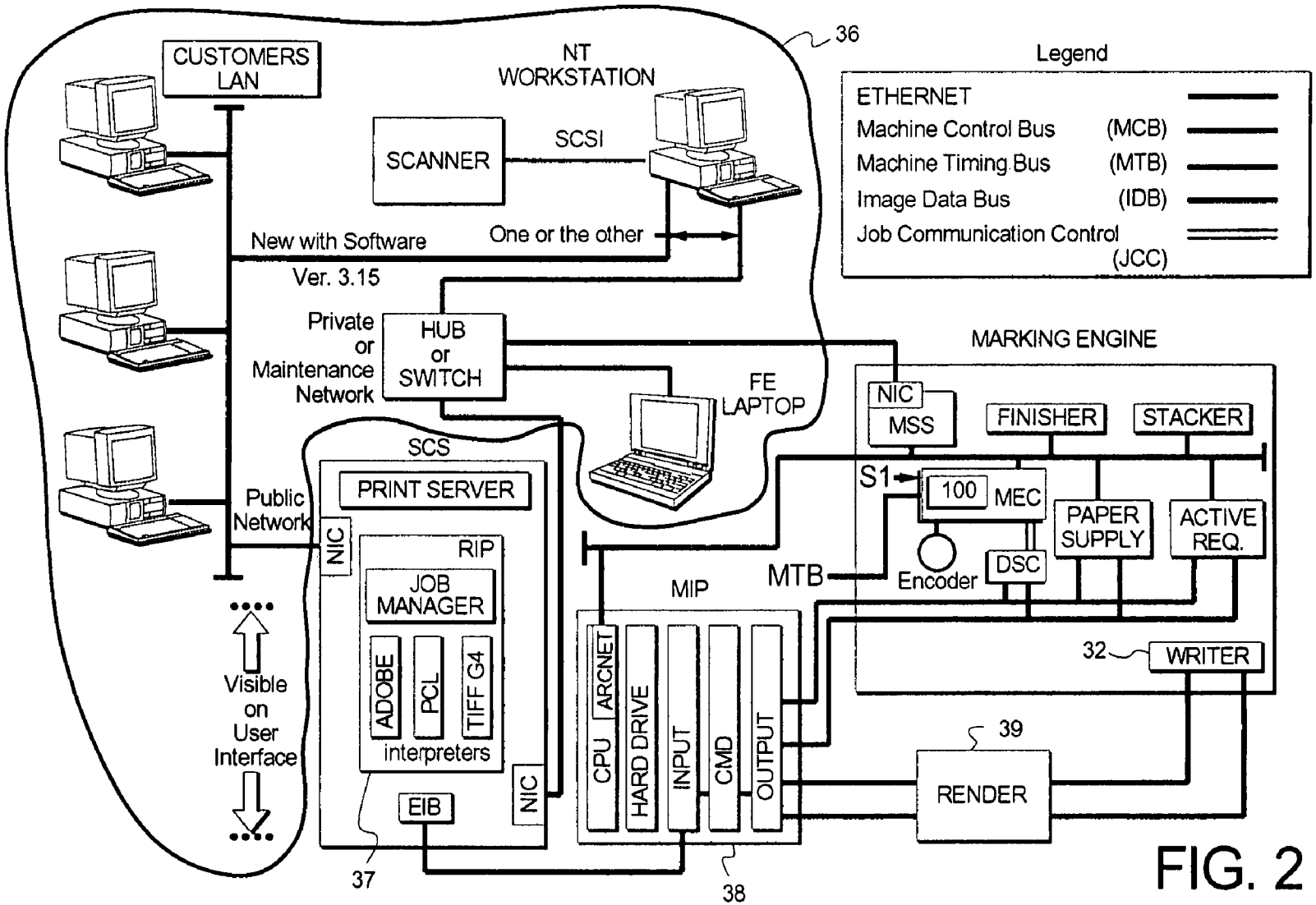

Referring now to FIGS. 1 and 2, a printer machine 10 comprise a moving electrographic imaging member 18 such as a photoconductive belt which is entrained about a plurality of rollers or other supports 21*a* through 21*g*, one or more of which is driven by a motor to advance the belt. By way of example, roller 21*a* is illustrated as being driven by motor 20. Motor 20 advances the belt at a high speed, for example 17 inches per second or higher (or 20, 24 inches per second, and faster), in the direction indicated by arrow P, past a series of workstations of the printer machine 10. Of course, slower speeds may be implemented in the practice of the invention. Alternatively, belt 18 may be wrapped and secured about only a single drum, or may be a drum.

Printer machine 10 includes a controller or logic and control unit (LCU) 24, preferably a digital computer or microprocessor operating according to a stored program for sequentially actuating the workstations within printer machine 10, effecting overall control of printer machine 10 and its various subsystems. LCU 24 also is programmed to provide closed-loop control of printer machine 10 in response to signals from various sensors and encoders. An encoder 2, for example, may be implemented to track movement of the electrographic imaging member 18. A sensor S1 may be implemented to sense indicia on the electrographic imaging member 18 that indicate image frames. The sensor S1 is operative to generate a sensor signal in response to sensing an indicium. If the electrographic imaging member 18 is a film, the indicia are preferably perforations, but any suitable mark may be implemented, for example a clear portion, reflective portion, portion of different color, etc. may be implemented with an appropriate sensor. A sensor S1 comprising a light emitter and receiver is suitable, as known in the art, for indicia that are perforations. Aspects of process control are described in U.S. Pat. No. 6,121,986 incorporated herein by this reference. Sensor S1 and encoder 21*b* communicate with a control circuit 100 according to numerous aspects of the invention, as will be discussed more fully herein. The control circuit 100 generates timing signals that may be communicated to other components within the Marking Engine and through a Main Timing Bus (MTB) for the ultimate use of coordinating the various activities.

A primary charging station 28 in printer machine 10 sensitizes belt 18 by applying a uniform electrostatic corona charge, from high-voltage charging wires at a predetermined primary voltage, to a surface 18*a* of belt 18. The output of charging station 28 is regulated by a programmable voltage controller 30, which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer machine 10 projects light from a writer 34*a* to belt 18. This light selectively dissipates the electrostatic charge on photoconductive belt 18 to form a latent electrostatic image of the document to be copied or printed. Writer 34*a* is preferably constructed as an array of light emitting diodes (LEDs), or alternatively as another light source such as a laser or spatial light modulator. Writer 34*a* exposes individual picture elements (pixels) of belt 18 with light at a regulated intensity and exposure, in the manner described below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from data source 36, in combination with control signals from LCU 24 are provided to a raster image processor (RIP) 37. The Digital images (including styled text) are converted by the RIP 37 from their form in a page description language (PDL) to a sequence of serial instructions for the electrographic printer in a process commonly known as "ripping" and which provides a ripped image to a image storage and retrieval system known as a Marking Image Processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the Marking Engine configuration (i.e., RIP time mismatch resolution); keep accounting record and error logs and provide this information to any subsystem, upon request; communicate image transfer requirements to the Marking Engine; translate the data from PDL (Page Description Language) to Raster for printing; and support diagnostics communication between User Applications. The RIP accepts a print job in the form of a Page Description Language (PDL) such as PostScript, PDF or PCL and converts it into Raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2K of the document. A job manager sends the job information to a MSS (Marking Subsystem Services) via Ethernet and the rest of the document further into the RIP to get rasterized. For clarification, the document header contains printer-specific information such as whether to staple or duplex the job. Once the document has been converted to raster by one of the interpreters, the Raster data goes to the MIP 38 via RTS (Raster Transfer Services); this transfers the data over a IDB (Image Data Bus).

The MIP functionally replaces recirculating feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to the Render Circuit. The amount of memory required to store a given number of images can be reduced by compressing the images; therefore, the images are compressed prior to MIP memory storage, then decompressed while being read from MIP memory.

The output of the MIP is provided to an image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35. Development station 35 includes a magnetic brush in juxtaposition to the belt 18. Magnetic brush development stations are well known in the art, and are preferred in many applications; alternatively, other known types of development stations or devices may be used. Plural development stations 35 may be provided for developing images in plural colors, or from toners of different physical characteristics. Full process color electrographic printing is accomplished by utilizing this process for each of four toner colors (e.g., black, cyan, magenta, yellow).

Upon the imaged portion of belt 18 reaching development station 35, LCU 24 selectively activates development station 35 to apply toner to belt 18 by moving backup roller or bar 35*a* against belt 18, into engagement with or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductor, thereby forming a developed image on the electrostatic image. As known in the art, conductor portions of development station 35, such as conductive applicator cylinders, are biased to act as electrodes. The electrodes are connected to a variable supply voltage, which is regulated by programmable controller 40 in response to LCU 24, by way of which the development process is controlled.

Development station 35 may contain a two component developer mix which comprises a dry mixture of toner and carrier particles. Typically the carrier preferably comprises high coercivity (hard magnetic) ferrite particles. As an example, the carrier particles have a volume-weighted diameter of approximately 30μ. The dry toner particles are substantially smaller, on the order of 6μ to 15μ in volume-weighted diameter. Development station 35 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to photoconductive belt 18 to develop the electrostatic images thereon and the carrier material remains at development station 35. As toner is depleted from the development station due to the development of the electrostatic image, additional toner is regularly introduced by toner auger 42 into development station 35 to be mixed with the carrier particles to maintain a uniform amount of development mixture. This development mixture is controlled in accordance with various development control processes. Single component developer stations, as well as conventional liquid toner development stations, may also be used.

A transfer station 46 in printing machine 10 moves a receiver sheet S into engagement with photoconductive belt 18, in registration with a developed image to transfer the developed image to receiver sheet S. Receiver sheets S may be plain or coated paper, plastic, or another medium capable of being handled by printer machine 10. Typically, transfer station 46 includes a charging device for electrostatically biasing movement of the toner particles from belt 18 to receiver sheet S. In this example, the biasing device is roller 46*b*, which engages the back of sheet S and which is connected to programmable voltage controller 46*a* that operates in a constant current mode during transfer. Alternatively, an intermediate member may have the image transferred to it and the image may then be transferred to receiver sheet S. After transfer of the toner image to receiver sheet S, sheet S is detacked from belt 18 and transported to fuser station 49 where the image is fixed onto sheet S, typically by the application of heat. Alternatively, the image may be fixed to sheet S at the time of transfer. The fuser station 49 implements the one or more of the apparatus and processes previously described in relation FIGS. 1-12. A fuser entry guide may be implemented between the transfer station 46 and the fuser station, for example, as described in U.S. patent application Ser. No. 10/668,416 filed Sep. 23, 2003, in the names of John Giannetti, Giovanni B. Caiazza, and Jerome F. Sleve, the contents of which are incorporated by reference as if fully set forth herein.

A cleaning station 48, such as a brush, blade, or web is also located behind transfer station 46, and removes residual toner from belt 18. A pre-clean charger (not shown) may be located before or at cleaning station 48 to assist in this cleaning. After cleaning, this portion of belt 18 is then ready for recharging and re-exposure. Of course, other portions of belt 18 are simultaneously located at the various workstations of printing machine 10, so that the printing process is carried out in a substantially continuous manner.

LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such from as a human user or a network control. The output data and control signals from LCU 24 are applied directly or through storage latches to suitable output drivers and in turn to the appropriate subsystems within printing machine 10.

Process control strategies generally utilize various sensors to provide real-time closed-loop control of the electrostatographic process so that printing machine 10 generates "constant" image quality output, from the user's perspective. Real-time process control is necessary in electrographic printing, to account for changes in the environmental ambient of the photographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. System changes that can occur over time include changes due to aging of the printhead (exposure station), changes in the concentration of magnetic carrier particles in the toner as the toner is depleted through use, changes in the mechanical position of primary charger elements, aging of the photoconductor, variability in the manufacture of electrical components and of the photoconductor, change in conditions as the printer warms up after power-on, triboelectric charging of the toner, and other changes in electrographic process conditions. Because of these effects and the high resolution of modern electrographic printing, the process control techniques have become quite complex.

Process control sensor may be a densitometer 76, which monitors test patches that are exposed and developed in non-image areas of photoconductive belt 18 under the control of LCU 24. Densitometer 76 may include a infrared or visible light LED, which either shines through the belt or is reflected by the belt onto a photodiode in densitometer 76. These toned test patches are exposed to varying toner density levels, including full density and various intermediate densities, so that the actual density of toner in the patch can be compared with the desired density of toner as indicated by the various control voltages and signals. These densitometer measurements are used to control primary charging voltage $V_O$, maximum exposure light intensity $E_O$, and development station electrode bias $V_B$. In addition, the process control of a toner replenishment control signal value or a toner concentration setpoint value to maintain the charge-to-mass ratio Q/m at a level that avoids dusting or hollow character formation due to low toner charge, and also avoids breakdown and transfer mottle due to high toner charge for improved accuracy in the process control of printing machine 10. The toned test patches are formed in the interframe area of belt 18 so that the process control can be carried out in real time without reducing the printed output throughput. Another sensor useful for monitoring process parameters in printer machine 10 is electrometer probe 50, mounted downstream of the corona charging station 28 relative to direction P of the movement of belt 18. An example of an electrometer is described in U.S. Pat. No. 5,956,544 incorporated herein by this reference.

Other approaches to electrographic printing process control may be utilized, such as those described in International Publication Number WO 02/10860 A1, and International Publication Number WO 02/14957 A1, both commonly assigned herewith and incorporated herein by this reference.

Raster image processing begins with a page description generated by the computer application used to produce the desired image. The Raster Image Processor interprets this page description into a display list of objects. This display list contains a descriptor for each text and non-text object to be printed; in the case of text, the descriptor specifies each text character, its font, and its location on the page. For example, the contents of a word processing document with styled text is translated by the RIP into serial printer instructions that include, for the example of a binary black printer, a bit for each pixel location indicating whether that pixel is to be black or white. Binary print means an image is converted to a digital array of pixels, each pixel having a value assigned to it, and wherein the digital value of every pixel is represented by only two possible numbers, either a one or a zero. The digital image in such a case is known as a binary image. Multi-bit images, alternatively, are represented by a digital array of pixels, wherein the pixels have assigned values of more than two number possibilities. The RIP renders the display list into a "contone" (continuous tone) byte map for the page to be printed. This contone byte map represents each pixel location on the page to be printed by a density level (typically eight bits, or one byte, for a byte map rendering) for each color to be printed. Black text is generally represented by a full density value (255, for an eight bit rendering) for each pixel within the character. The byte map typically contains more information than can be used by the printer. Finally, the RIP rasterizes the byte map into a bit map for use by the printer. Half-tone densities are formed by the application of a halftone "screen" to the byte map, especially in the case of image objects to be printed. Pre-press adjustments can include the selection of the particular halftone screens to be applied, for example to adjust the contrast of the resulting image.

Electrographic printers with gray scale printheads are also known, as described in International Publication Number WO 01/89194 A2, incorporated herein by this reference. As described in this publication, the rendering algorithm groups adjacent pixels into sets of adjacent cells, each cell corresponding to a halftone dot of the image to be printed. The gray tones are printed by increasing the level of exposure of each pixel in the cell, by increasing the duration by way of which a corresponding LED in the printhead is kept on, and by "growing" the exposure into adjacent pixels within the cell.

Ripping is printer-specific, in that the writing characteristics of the printer to be used are taken into account in producing the printer bit map. For example, the resolution of the printer both in pixel size (dpi) and contrast resolution (bit depth at the contone byte map) will determine the contone byte map. As noted above, the contrast performance of the printer can be used in pre-press to select the appropriate halftone screen. RIP rendering therefore incorporates the attributes of the printer itself with the image data to be printed.

The printer specificity in the RIP output may cause problems if the RIP output is forwarded to a different electrographic printer. One such problem is that the printed image will turn out to be either darker or lighter than that which would be printed on the printer for which the original RIP was performed. In some cases the original image data is not available for re-processing by another RIP in which tonal adjustments for the new printer may be made.

Figure 3A:
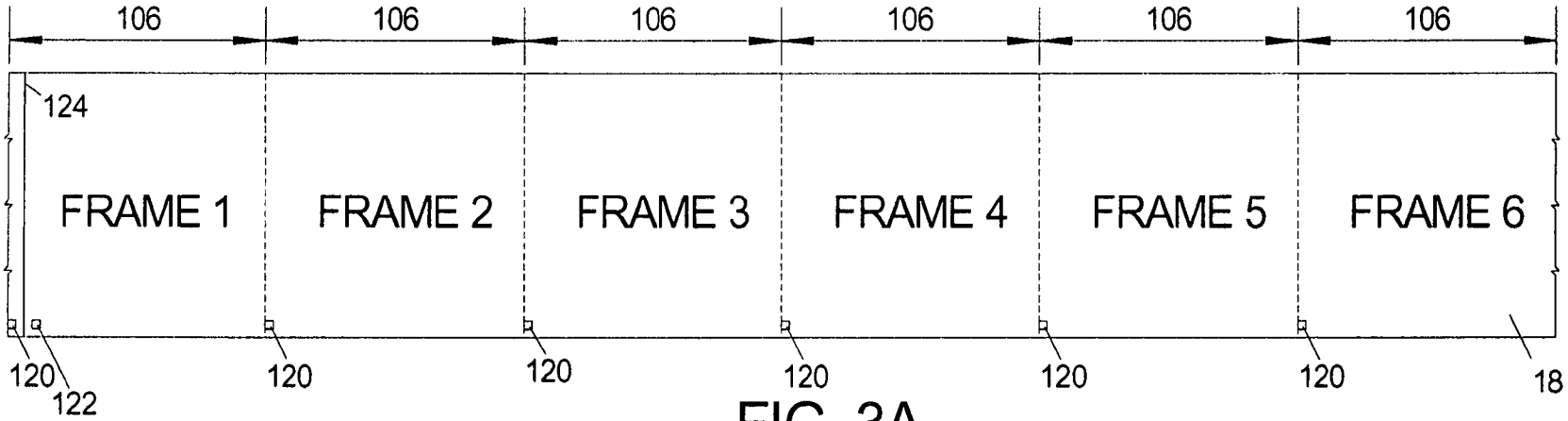
FIG. 3A presents an electrographic imaging member according to an aspect of the invention.
Figure 3B:
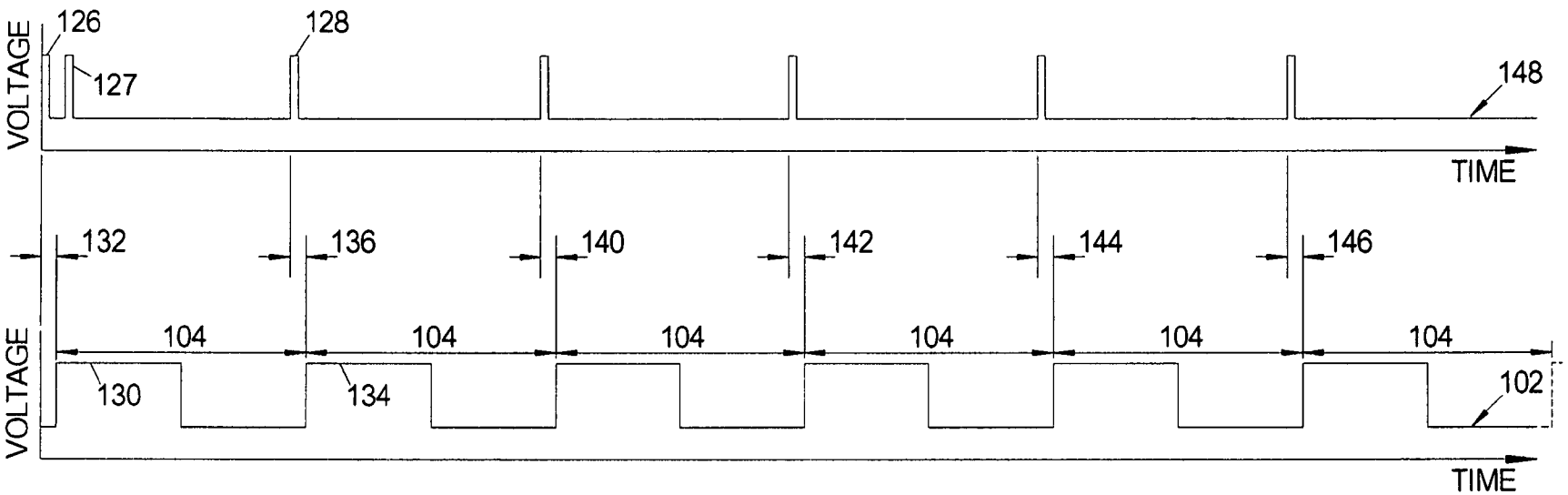
FIG. 3B presents certain timing signals according to various aspects of the invention.
Figure 4A:
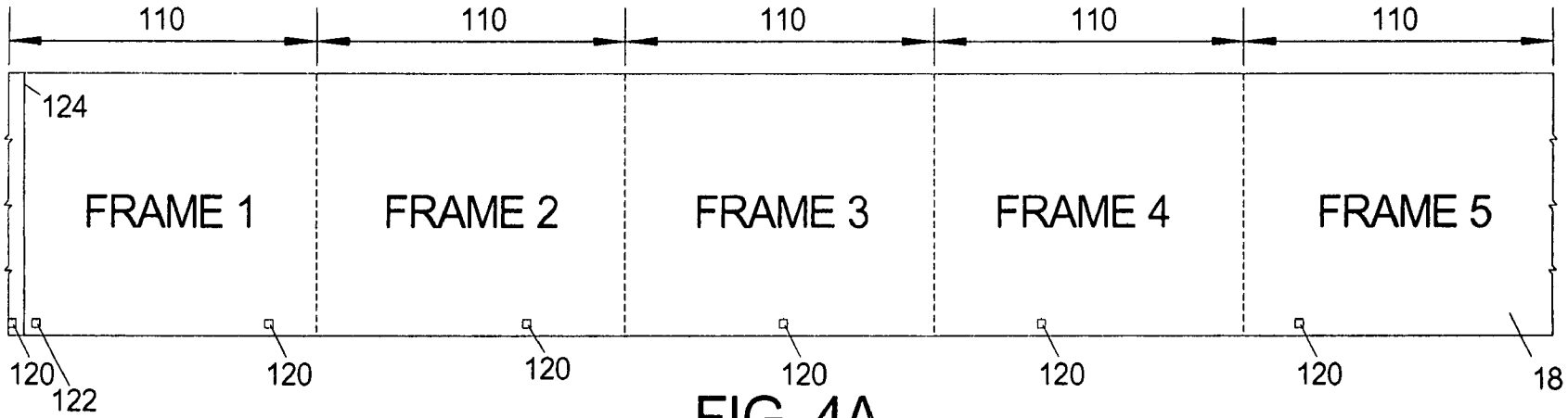
FIG. 4A presents an electrographic imaging member according to an aspect of the invention.
Figure 4B:
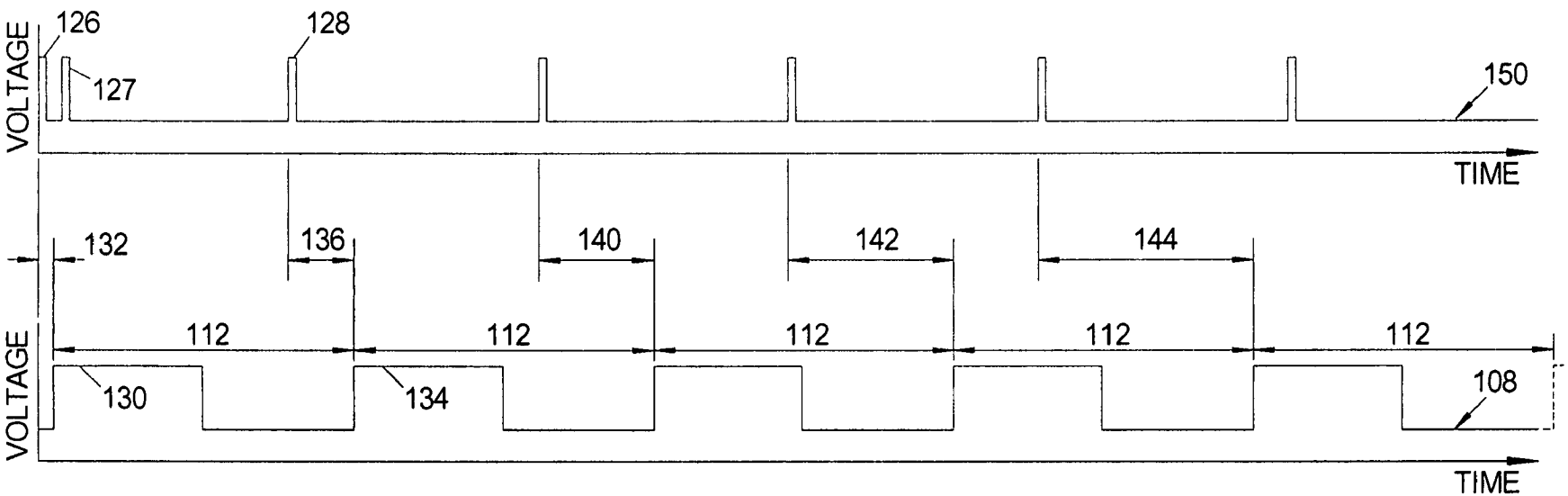
FIG. 4B presents certain timing signals according to various aspects of the invention.
Figure 5A:
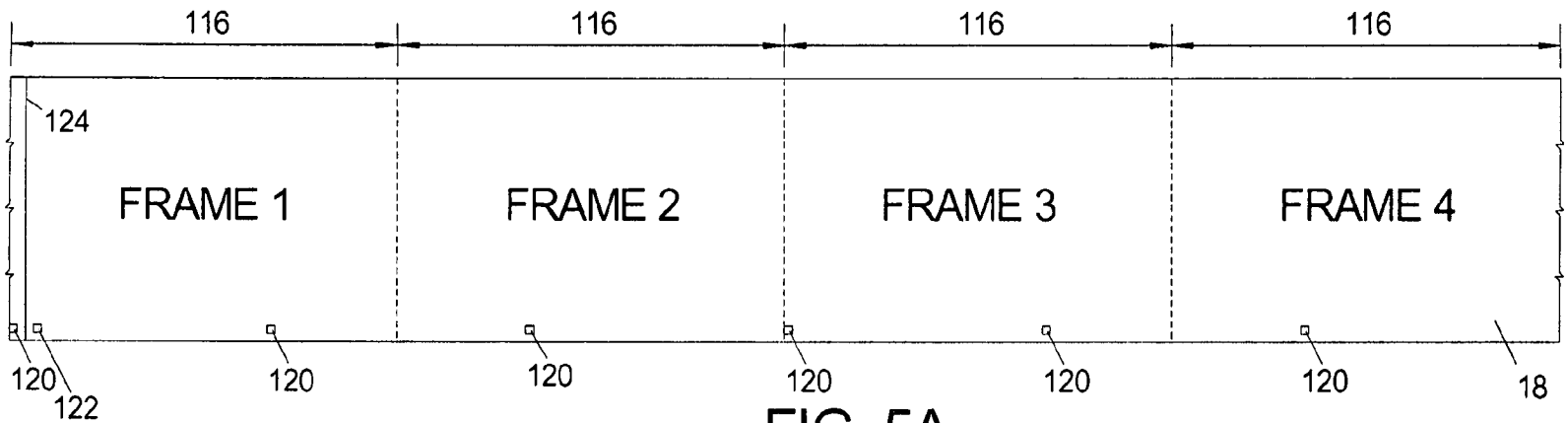
FIG. 5A presents an electrographic imaging member according to an aspect of the invention.
Figure 5B:
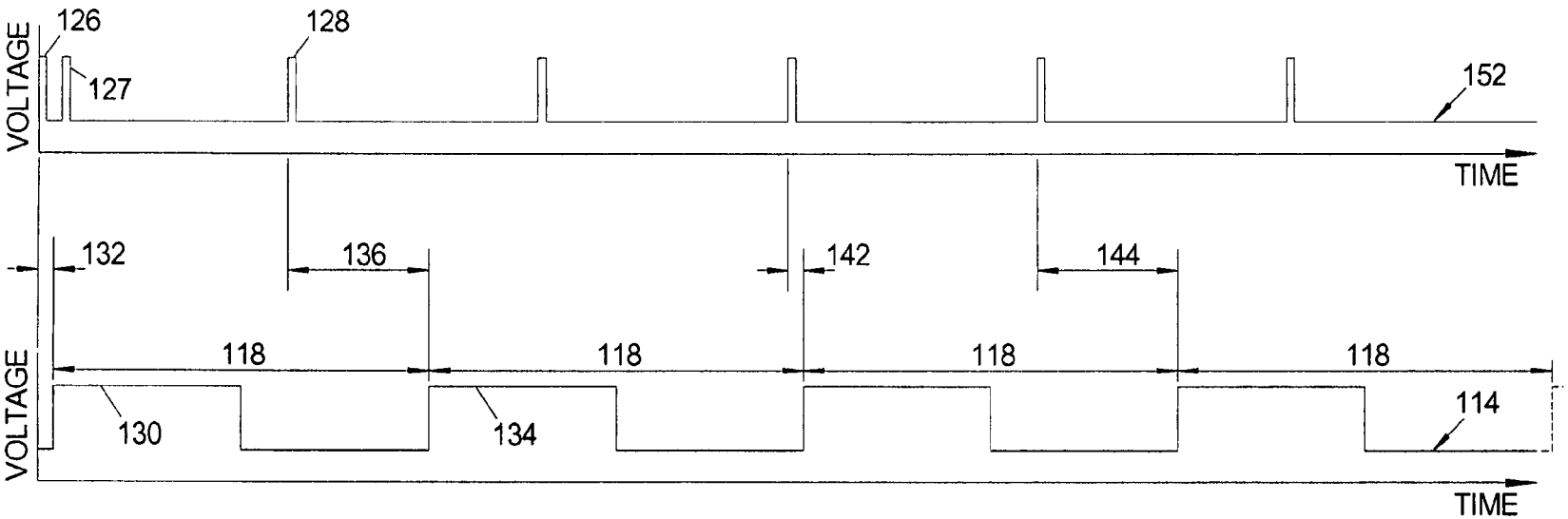
FIG. 5B presents certain timing signals according to various aspects of the invention.

Referring to FIGS. 3A through 5B, a printing process is presented according to one aspect of the invention, comprising generating a periodic timing signal 102 having a period 104 that may correspond to a first frame size 106, and alternatively generating an alternative periodic timing signal 108 that may correspond to a second frame size 110 and having an alternative period 112 different from the period 104. As used herein, "periodic" means characterized by periods: occurring at regular intervals. Referring now to FIGS. 5A and 5B, the process may comprise generating an alternative periodic timing signal 114 corresponding to a third frame size 116 and having an alternative period 118 different from the period 104, and may also be different the alternative period 112. In FIGS. 3A, 4A, and 5A, the electrographic imaging member 18 actually a continuous loop, but is shown in schematic form with a cut immediately adjacent the beginning of Frame 1 and laid flat, in order to assist in explaining the invention. FIGS. 3A and 3B present a six (6) frame mode, and indicia 120 partition the electrographic imaging member 18 accordingly. FIGS. 4A and 4B present a five (5) frame mode, and FIGS. 5A and 5B present a four (4) frame mode. Of course, other modes from one (1) frame mode and more, and altering from one to another, are contemplated in the practice of the invention. As is evident from the description provided herein, the electrographic imaging member 18 need not be partitioned into equal segments, as is disclosed in U.S. Pat. No. 6,295,424, although equal segments are specified in certain embodiments. The U.S. Pat. No. 6,295,424 patent is hereby incorporated by reference as if fully set forth herein.

According to a further aspect of the invention, the control circuit 100 creates virtual indicia that are variable distances from physical indicia 120 to create alternate frame modes, for example 4, 5, 6 and 7 mode image cycles, a frame mode being a number of frames that the electrographic imaging member 18 is divided into per revolution. This may be useful to improve performance of the printer, for example to improve productivity with receiver sheets of various sizes. As many indicia as possible may be used to reduce the error in the placement of the image on the image loop, and of the receiver to the electrographic imaging member 18 and image. A splice indicium 122 indicating a location of a splice 124 in the electrographic imaging member may also be provided.

The processes according to the various aspects of the invention may comprise virtually partitioning the electrographic imaging member 18 into a second number of frames (4 or 5, for example, as shown in FIGS. 4A and 5A) less than a first number of frames (6, for example, as shown in FIG. 3A), the electrographic imaging member 18 comprising a plurality of indicium 120 that physically partition the electrographic imaging member into the first number of frames. The first number of frames divided by the second number of frames may be other than 2. Of course, the Frame numbers of 4, 5 and 6 are used for purposes of explanation and the invention is not limited specifically to these examples.

According to a preferred embodiment, a plurality of indicium (at least two) are implemented. If virtual perforations are created from only one indicium the error incurred in the image registration and the paper registration tends to increase with distance from that indicia due to film handling or encoder error. The error may be too great for a desired product specification. Error may be reduced by spacing the virtual indicia as close to a physical indicia as possible (even though this may be a different distance for each frame mode).

Referring again to FIG. 4B, a printing process is provided according to a further aspect of the invention, comprising sensing a first indicium 120 on an electrographic imaging member 18 with a sensor, such as sensor S1, and generating a first sensor signal 126 in response, sensing a second indicium 120 on the electrographic imaging member with the sensor S1 and generating a second sensor signal 128 in response, generating a first frame signal 130 in response to the first sensor signal 124 with a first interval 132 from the first sensor signal 126, and generating a second frame signal 134 in response to the second sensor signal 128 with a second interval 136 from the second sensor signal 128, the second interval 136 being different from first interval 132. The splice indicium 122, if present, generates a splice signal 127. A repetitive sensor signal 150 comprises the sensor signals 126, 127, 128, and subsequent indicium-generated signals. Either the first interval 132 or the second interval 136 may be zero, but not both, since they are different. In a certain embodiment, the first interval 132 and the second interval 136 are non-zero due to hardware limitations in the stability of a timer/counter (a minimum number of counts ensures an accurate and repeatable interval).

Still referring to FIG. 4B, the processes according to the various aspects of the invention may comprise generating a periodic timing signal 108 comprising the first frame signal 130 and the second frame signal 134. This may be done by repeatedly generating frame signals in response to sensor signals, with varying intervals, as shown in Table 1 (which is representative of a film loop having a length that generates 34,322 encoder pulses per revolution).

TABLE 1

| Frame Signal | FIG. 4B - Interval (encoder pulses) |
|---|---|
| 1 | 4 (interval 132) |
| 2 | 1144 (interval 136) |
| 3 | 2288 (interval 140) |
| 4 | 3433 (interval 142) |
| 5 | 4577 (interval 144) |
| 6 | Skip |

After Frame 6, the flow returns to Frame 1, since the electrographic imaging member 18 is a rotating closed loop. As will be discussed in more detail, the signal 127 for the splice indicium 122 is skipped when generating the periodic timing signal 138. Referring again to FIG. 5B, a printing process is provided according to a further aspect of the invention, comprising sensing the first indicium 120 on the electrographic imaging member 18 with the sensor S1, and generating a first sensor signal 126 in response, sensing a second indicium 120 on the electrographic imaging member with the sensor S1 and generating the second sensor signal 128 in response, generating the first frame signal 130 in response to the first sensor signal 124 with the first interval 132 from the first sensor signal 126, and generating the second frame signal 134 in response to the second sensor signal 128 with the second interval 136 from the second sensor signal 128, the second interval 136 being different from first interval 132. A repetitive sensor signal 152 comprises the sensor signals 126, 127, 128, and subsequent indicium-generated signals. As before, a periodic timing signal 114 comprises the first frame signal 130 and the second frame signal 134, but with varying intervals according to Table 2.

TABLE 2

| Frame Signal | FIG. 5B - Interval (encoder pulses) |
|---|---|
| 1 | 4 (interval 132) |
| 2 | 2861 (interval 136) |
| 3 | Skip |
| 4 | 4 (interval 142) |
| 5 | 2861 (interval 144) |
| 6 | Skip |

A periodic timing signal may also be generated with the frame mode corresponding directly to the number of frames into which the electrographic imaging member 18 is physically partitioned. Referring again to FIG. 3B, the electrographic imaging member 18 is physically partitioned into six (6) frames, as previously described. A periodic timing signal 102 for a corresponding 6 frame mode is generated by implementing a constant interval, as presented on Table 3. A repetitive sensor signal 148 comprises the sensor signals 126, 127, 128, and subsequent indicium-generated signals.

TABLE 3

| Frame Signal | FIG. 4B - Interval (encoder pulses) |
|---|---|
| 1 | 4 (interval 132) |
| 2 | 4 (interval 136) |
| 3 | 4 (interval 140) |
| 4 | 4 (interval 142) |
| 5 | 4 (interval 144) |
| 6 | 4 (interval 146) |

According to various further aspects of the invention, the processes disclosed herein may comprise generating the periodic timing signal 102, 108, 114 comprising the first frame signal 130 and the second frame signal 134, and changing the periodic timing signal 102, 108, 114 to an alternative periodic timing signal 102, 108, 114 having an alternative period 104, 112, 118 at least in part by changing at least one of the first interval 132 and the second interval 136. For example, the periodic timing signal 102 of FIG. 3B may be changed to an alternative timing signal 108 of FIG. 4B and vice versa, and/or the periodic timing signal 108 of FIG. 4B may be changed to the alternative timing signal 114 of FIG. 5B and vice versa, and/or the periodic timing signal 114 of FIG. 5B may be changed to the periodic timing signal 102 of FIG. 3B and vice versa. These examples are not intended to be restrictive since the possible combinations are too numerous to list, particularly since the frame modes are not limited to the examples of 4, 5, and 6 presented herein the purposes of explanation. As is evident from the examples, one of the first number of frames and the second number of frames maybe even, another of the first number of frames and the second number of frames may be odd.

As previously discussed with reference to Tables 1, 2 and 3, additional intervals 142 et. seq. may also be changed. One of the periodic timing signals 102, 108, and 114 may correspond to a first frame size, and the alternative periodic timing 102, 108 and 114 signal corresponding to a second frame size. In such case, a first period 104 corresponds to the first number of frames; and a second (or alternative) period corresponds to the second number of frames.

According to various further aspects of the invention, the processes disclosed herein may comprise generating a periodic timing signal 102, 108, 114 initiated by the indicia 120 on the electrographic imaging member 18, and alternatively generating an alternative periodic timing signal 102, 108, 114 initiated by at least one of the indicia 120. Furthermore, the sensor S1 sensing the indicia 120 may initiate the periodic timing signal 102, 108, 114 and the alternative periodic timing signal 102, 108, 114, as is evident from FIGS. 3B, 4B, and 5B.

If there is no splice indicium, the repetitive sensor signals 148, 150 and 152 are periodic, but generally a splice indicium 127 is implemented with a film electrographic imaging member 18 since such imaging members generally have splices (they are not "seamless"). A drum electrographic imaging member 18, however, need not have a splice and may simplify implementation of the invention.

Figure 6:
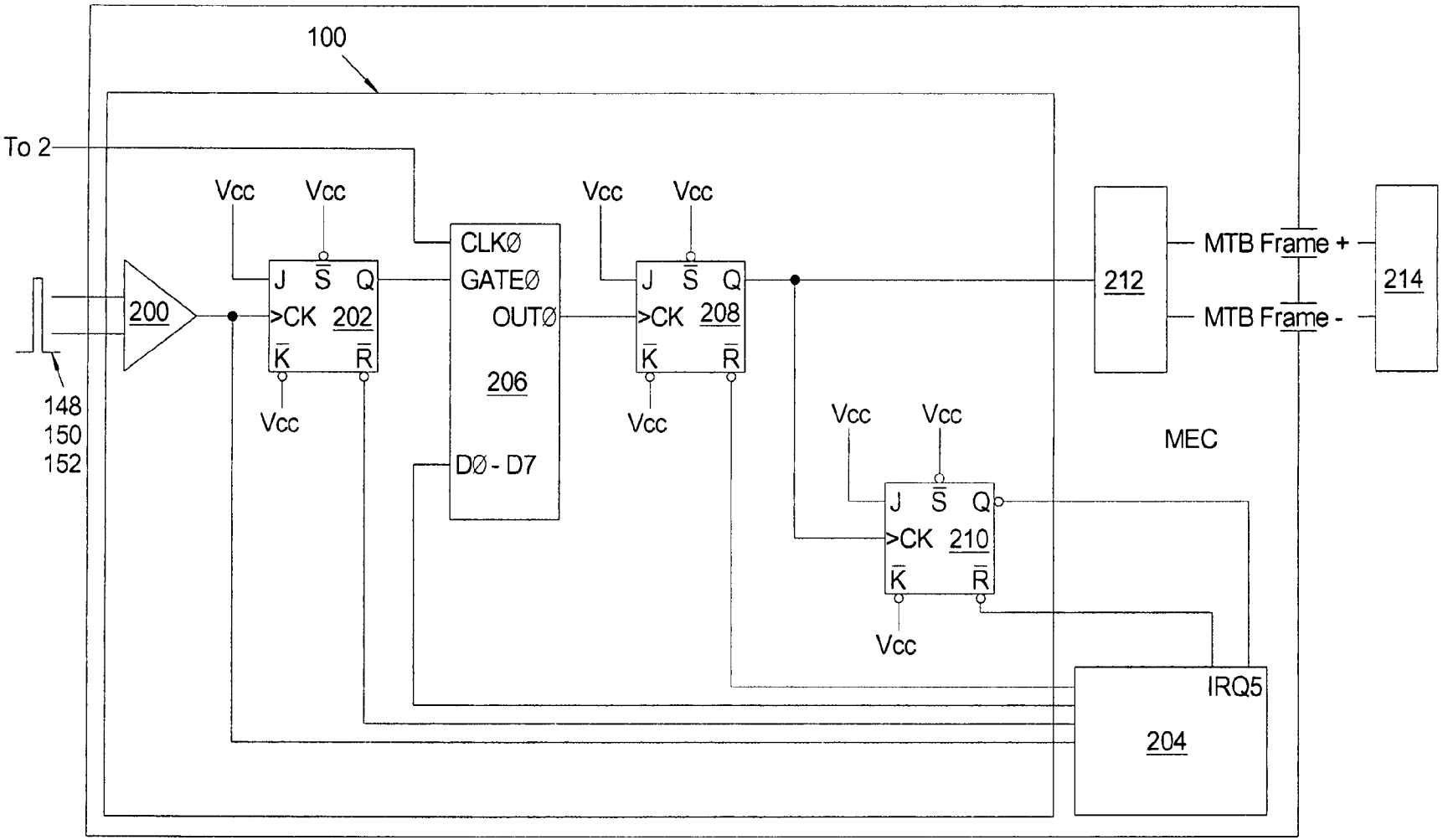
FIG. 6 presents a schematic diagram of a controller according to a further aspect of the invention.

Referring now to FIG. 6, a schematic of control circuit 100 is presented showing a hardware/code implementation. The repetitive sensor signal 148, 150, 152 is input to a voltage comparator 200 that converts the signal 148, 150, 152 to a TTL signal. The TTL signal is communicated to a flip-flop 202.

The TTL signal is also communicated to a controller 204. The hardware/code maintains a counter that keeps track of the current frame number, and that depends on the current frame mode. For example, in five (5) frame mode, the counter increments from 1 to 5 and resets to 1 upon receipt of the splice indicium signal 127.

The TTL signal is a representation of the raw repetitive sensor signal 148, 150, 152 and includes the splice indicium signal 127 (if the electrographic imaging member 18 has the splice indicium 122). Upon receiving the first sensor signal 126 the state of flip-flop 202 switches and the hardware and code waits a minimum period of time to reset the flop-flop 202 so as to miss the splice indicium signal 127. In such manner, the splice indicium signal 127 is filtered. Any sensor signal may be skipped, for example as may be required by Table 1 or 2, by waiting an appropriate period of time to miss a particular signal corresponding to a particular indicium 120. The hardware and code can do this because it keeps track of the current frame number, it knows whether that sensor signal is supposed to be skipped, and the amount of time to wait before resetting the flip-flop 202 to ensure that it is indeed skipped.

Thus, the flip-flop 202 communicates a filtered signal to GateØ of a counter 206 (a timer/counter such as an Intel 8254 timer/counter). The hardware/code loads the counter 206 with an encoder count number for each frame (as presented in Tables 1, 2, and 3, for example). Again, the hardware/code knows which frame it is processing and the encoder count number for that frame.

The output from counter 206 is communicated to another flip-flop 208. Each rising edge changes the state of the flip-flop 208, and the hardware/code resets the flip-flop at a time corresponding to about 50% of the period 102, 112, 118 (merely a matter of choice). The output of flip-flop 208 corresponds to the periodic timing signal 102, 108, 114. This signal is communicated to a third flip-flop 210 that acts an interface to the MEC. The MEC resets the flip-flop 210 as soon as it is done processing the previous interrupt received from the flip-flop 210. The periodic timing signal 102, 108, 114 is distributed within the MEC for timing control of the various components such as receiver feeds, receiver registration, image registration, paper path control, jam control and recovery, etc.

The output from counter 206 is also communicated to a differential driver 212 that generates an amplified signal on the Main Timing Bus (MTB) that is noise-robust. The MTB travels external to the MEC to other components such one or more modular paper supplies, a modular post-fuser inserter, and in-line finishing equipment. These devices are provided with a differential receiver 214 that reverts the MTB signal to TTL in the receiving device.

The Frame Mode may be determined by operator input, but more preferably is determined by the in-track size of the receiver. A range of paper sizes versus Frame Mode is presented in Table 4.

TABLE 4

| Frame Mode | Max Receiver Size (in-track) | Effective Speed in Simplex |
|---|---|---|
| 6 | 9.0 inch | 150 ppm |
| 5 | 10.9 inch | 125 ppm |
| 4 | 13.8 inch | 100 ppm |
| 3 | 18.5 inch | 75 ppm |

As is evident from Table 4, decreasing the Frame Mode decreases the effective speed of the printer (expressed as "ppm"—pages per minute). Thus, the MEC is preferably programmed to choose a frame mode that provides the maximum Frame Mode for a given in-track receiver size, and thereby the highest effective speed for the printer. In prior machines limited to 3 and 6 frame mode, receivers with an in-track length over 9.0 inches were run in 3 frame mode at an effective speed of 75 ppm. According to an aspect of the invention, a receiver too large for 6 frame mode may be run at 5 or 4 frame mode at an effective speed of 125 ppm or 100 ppm.

Figure 7:
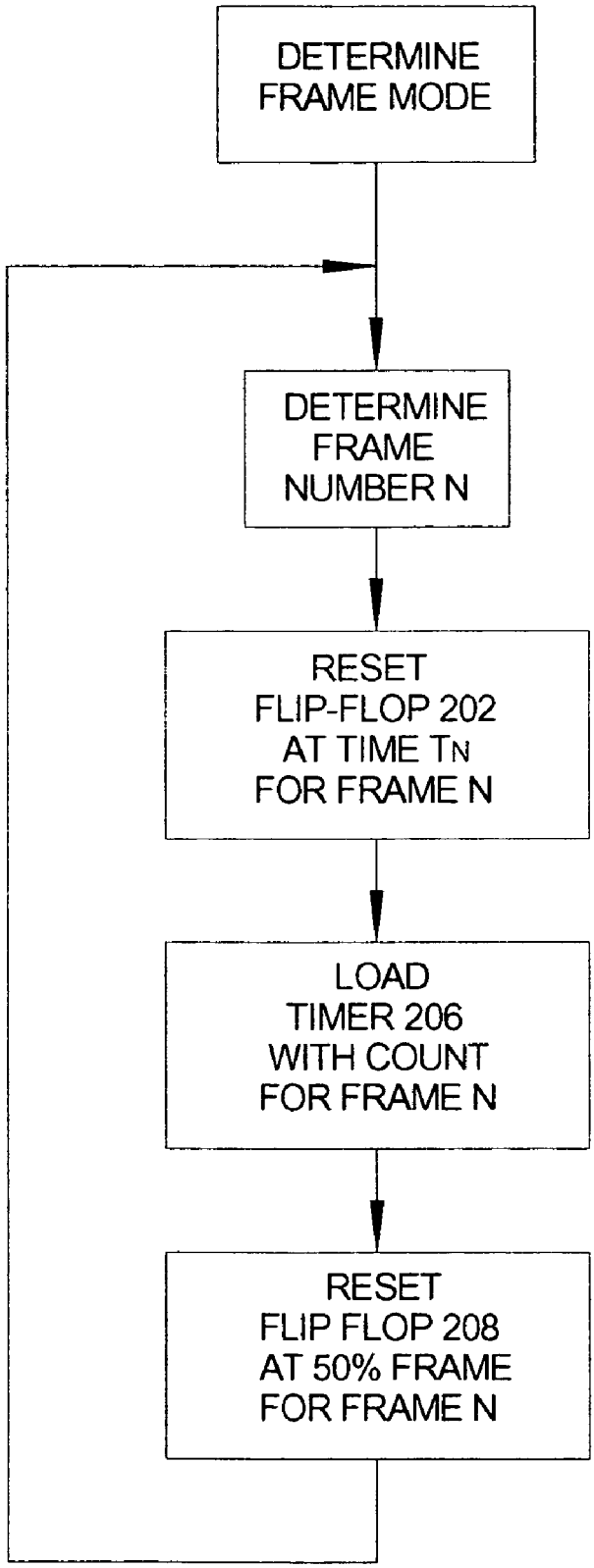
FIG. 7 presents a schematic flow chart.

A schematic flow diagram is presented in FIG. 7. As previously described, the various processes according to the various aspects of the invention may be implemented by the control circuit 100 being operable to perform one or more steps. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements have been described as being implemented by software, in other embodiments hardware or firmware implementations may alternatively be used, and vice-versa. Similarly, the controllers may implement software, hardware, and/or firmware. In view of the wide variety of embodiments to which the principles of the present invention can be applied, it should be understood that the illustrated embodiments are exemplary only, and should not be taken as limiting the scope of the present invention.

The various aspects of the invention may be implemented with other apparatus, for example an apparatus and method for advancing a receiver into registered relationship with a moving image-bearing member, as described in U.S. Pat. No. 6,641,134 issued to Dobbertin et al. on Nov. 4, 2003, entitled "System and Method for Improved Registration Performance", the contents of which are hereby incorporated by reference as if fully set forth herein. A sensor similar to sensor S1 that senses the indicia may be placed adjacent to the receiver to image registration apparatus, upstream of the location where the receiver contacts the imaging member for example, and the signals from such sensor may be processed as disclosed herein to alter frame modes for the receiver to image registration control.

The claims should not be read as limited to the described order or elements unless stated to that effect. In addition, use of the term "means" in any claim is intended to invoke 35 U.S.C. §112, paragraph 6, and any claim without the word "means" is not so intended.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. A printing process, comprising:

sensing a first indicium on an electrographic imaging member with a sensor and generating a first sensor signal in response;

sensing a second indicium on the electrographic imaging member with the sensor and generating a second sensor signal in response; and generating a first frame signal in response to the first sensor signal with a first interval from the first sensor signal; and generating a second frame signal in response to the second sensor signal with a second interval from the second sensor signal, the second interval being different from first interval.

2. The process of claim 1, comprising a splice indicium indicating a location of a splice in the electrographic imaging member.

3. The process of claim 1, comprising generating a periodic timing signal comprising the first frame signal and the second frame signal.

4. The process of claim 1, comprising:

generating a periodic timing signal comprising the first frame signal and the second frame signal and having a period; and changing the periodic timing signal to an alternative periodic timing signal having art alternative period at least in part by changing at least one of the first interval and the second interval.

5. The process of claim 4, the periodic timing signal corresponding to a first frame size, and the alternative periodic timing signal corresponding to a second frame size.

6. A printer, comprising:

an electrographic imaging member comprising a first indicium and a second indicium;

a sensor operative to generate a first sensor signal in response to sensing the first indicium, and to generate a second sensor signal in response to sensing the second indicium; and a controller operative to generate a first frame signal in response to the first sensor signal with a first interval from the first sensor signal, and to generate a second frame signal in response to the second sensor signal with a second interval from the second sensor signal, the second interval being different from first interval.

7. The printer of claim 6, the controller comprising a counter and a flip-flop.

8. The printer of claim 6, comprising a splice indicium indicating a location of a splice in the electrographic imaging member.

9. The printer of claim 6, the controller being operative to generate a periodic timing signal comprising the first frame signal and the second frame signal.

10. The printer of claim 6, the controller being operative to generate a periodic timing signal comprising the first frame signal and the second frame signal, and to change the periodic timing signal to an alternative periodic timing signal having an alternative period at least in part by changing at least one of the first interval and the second interval.

11. The printer of claim 10, the periodic timing signal corresponding to a first frame size, and the alternative periodic timing signal corresponding to a second frame size.

12. A printing process, comprising:

virtually partitioning an electrographic imaging member into a second number of frames less than a first number of frames, the electrographic imaging member comprising a plurality of indicium that physically partition the electrographic imaging member into the first number of frames, the first number of frames divided by the second number of frames being other than 2.

13. The process of claim 12, comprising a splice indicium indicating a location of a splice in the electrographic imaging member.

14. The process of claim 12, comprising:

generating a periodic timing signal having a first period corresponding to the first number of frames; and generating an alternative timing signal having an alternative period corresponding to the second number of frames.

15. The process of claim 12, one of the first number of frames and the second number of frames being even, another of the first number of frames and the second number of frames being odd.

16. A printer, comprising:

an electrographic imaging member comprising a plurality of indicium that partition the electrographic imaging member into a first number of frames; and a controller operative to partition the electrographic imaging member into a second number of frames less than the first number of frames, the first number of frames divided by the second number of frames being other than 2.

17. The printer of claim 16, the controller comprising a counter and a flip-flop.

18. The printer of claim 16, comprising a splice indicium indicating a location of a splice in the electrographic imaging member.

19. The printer of claim 16, the controller being operative to generate a periodic timing signal having a period corresponding to the first number of frames, and to generate an alternative periodic timing signal having an alternative period corresponding to the second number of frames.

20. The printer of claim 16, one of the first number of frames and the second number of frames being even, another of the first number of frames and the second number of frames being odd.

* * * * *